US009284173B2

(12) United States Patent
Krulitsch

(10) Patent No.: US 9,284,173 B2
(45) Date of Patent: Mar. 15, 2016

(54) FILLING MACHINE AND METHOD FOR CONTROLLING A FILLING MACHINE

(75) Inventor: Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 158 days.

(21) Appl. No.: 14/240,462

(22) PCT Filed: Aug. 2, 2012

(86) PCT No.: PCT/EP2012/003280

§ 371 (c)(1),
(2), (4) Date: Feb. 24, 2014

(87) PCT Pub. No.: WO2013/026523

PCT Pub. Date: Feb. 28, 2013

(65) Prior Publication Data

US 2014/0216597 A1 Aug. 7, 2014

(30) Foreign Application Priority Data

Aug. 23, 2011 (DE) ..... 10 2011 110 840

(51) Int. Cl.

| | |
|---|---|
| ***B65B 1/04*** | (2006.01) |
| ***B67C 3/00*** | (2006.01) |
| ***B67C 3/22*** | (2006.01) |
| *B67C 3/26* | (2006.01) |

(52) U.S. Cl.

CPC . *B67C 3/004* (2013.01); *B67C 3/22* (2013.01); *B67C 3/005* (2013.01); *B67C 2003/2668* (2013.01)

(58) Field of Classification Search

CPC ..... B67C 3/004; B67C 3/005; B67C 3/22; B67C 3/244; B67C 2003/2668

USPC ..... 141/90, 244

See application file for complete search history.

(56) References Cited

U.S. PATENT DOCUMENTS

| | | | | |
|---|---|---|---|---|
| 5,562,129 | A * | 10/1996 | Graffin | B67C 3/004 141/147 |
| 8,757,216 | B2 * | 6/2014 | Meinzinger | B67C 3/002 141/1 |
| 2010/0107557 | A1 * | 5/2010 | Macquet | B67C 3/004 53/266.1 |
| 2011/0232233 | A1 * | 9/2011 | Klarl | B67C 3/22 53/426 |

FOREIGN PATENT DOCUMENTS

| | | |
|---|---|---|
| DE | 60001062 | 7/2003 |
| DE | 10 2007 024102 | 11/2008 |
| DE | 10 2009 033 575 | 1/2011 |
| DE | 10 2009 033557 | 1/2011 |
| EP | 0 785 134 | 7/1997 |
| EP | 1 577 258 | 9/2005 |
| EP | 2 246 291 | 11/2010 |

* cited by examiner

*Primary Examiner* — Jason K Niesz

(74) *Attorney, Agent, or Firm* — Occhiuti & Rohlicek LLP

(57) ABSTRACT

A filling machine for filling containers includes a rotor, a transport element, a vertical machine axis, and filling positions, each of which comprises a filling element, a container support, and a closure element, and a common actuating drive for all closure elements of the filling machine. The transport element revolves on the rotor about the machine axis. The filling positions are on the transport element. The closure element is a rinsing cap or a rinsing sleeve. Each closure element is movable by the common actuating drive between a parking position and a working position. In the parking position, the closure element is within a movement path of the filling elements. In the working position, the closure element is coaxial with the associated filling element and below the filling element.

17 Claims, 8 Drawing Sheets

FILLING MACHINE AND METHOD FOR CONTROLLING A FILLING MACHINE

RELATED APPLICATIONS

This application is the national stage entry under 35 USC 371 of PCT/EP2012/003280, filed on Aug. 2, 2012, which claims the benefit of the Aug. 23, 2011 priority date of German application DE 10 2011 110 840.1, the contents of which are herein incorporated by reference.

BACKGROUND

The invention relates to a filling machine and to a method of operating a filling machine.

BACKGROUND

Filling machines for filling containers with a liquid filling material are known in different versions and for different filling methods (e.g. pressure filling, pressureless filling, free jet filling etc.). Also known in particular are filling machines of a revolving design with a rotor that is driven so as to revolve about a vertical machine axis, with a large number of filling positions for filling the containers, each having a filling element with a filling material delivery opening and a container support, being formed at the circumference of the rotor.

For hygienic reasons alone, in particular also to avoid microbial contamination of the filling machine and possibly also during a product changeover, it is necessary to clean, disinfect and/or sterilize the filling machine and, in particular, its components and/or flow paths that convey the filling material. This cleaning and/or disinfection is basically performed as CIP cleaning and/or CIP disinfection in a cleaning and/or disinfection operation, namely using closure elements, for example in the form of rinsing caps or rinsing sleeves, with which the filling elements in the area of their filling material delivery openings are closed at least liquid-tight.

In this context, it is also known from DE 10 2009 033 575 A1 to move closure elements, which are independently assigned to each filling element and arranged at the rotor, such movement being effected by pivoting about an axis oriented parallel to the machine axis between a parking position, in which the closure element is located during the filling operation, and a working position, in which the closure element, underneath the filling element and during the cleaning and/or disinfection operation of the filling machine, tightly presses against the associated filling element in the sealing position. A self-contained pneumatic drive is provided, at each filling position, for the movement of the closure elements, with the being designed as a lifting-and-pivoting drive, not only for the pivoting of the closure elements between the parking position and the working position but also for the lifting of the closure elements parallel to the machine axis so that they can be pressed against or removed from the filling element concerned. This solution is complex in design, expensive, and also fault-prone.

Also known is a container treatment machine of a revolving design, as shown in DE 103 40 365 A1, with several treatment stations, each with a treatment head, provided at the circumference of a rotor that is driven so as to revolve about a vertical machine axis. Underneath the treatment heads, a support ring which concentrically encloses the machine axis, is provided, with several exchange component groups being provided successively on the support ring in the circumferential direction of the support ring, each exchange component group having several different exchange components for adapting the treatment heads to different containers and/or modes of operation of the container treatment machine. The exchange components, of which an exchange component in each exchange component group is also a closure element for CIP cleaning and/or CIP disinfection of the treatment heads, are located underneath the treatment heads and move, with the rotor revolving, on a common path of movement with the treatment heads. Pivoting or twisting the support ring can couple the respective desired exchange component to each treatment head. A certain disadvantage of this is that, for example, by arranging the exchange components on the orbit of the treatment heads, i.e. at the same radial distance from the machine axis as the treatment heads, a minimum distance must be kept between neighboring treatment heads. This imposes design limitations.

SUMMARY

An object of the invention is to provide a filling machine with closure elements, each allocated to the filling elements or filling positions, that enables movement of the closure elements between their parking positions and their working positions in a simplified design and with high operational safety.

According to one aspect of the invention, differs from prior art because it has a common actuating or pivoting drive for the movement of the closure elements between their parking positions and their working positions, and because the closure elements are in their parking positions within the path of movement on which the filling elements revolve when the transport element is driven, for example when the rotor is driven, or because, for a transport element designed as a rotor, the closure elements, which are in the parking position, have a radial distance from the machine axis, that distance being smaller than the radial distance of the filling elements from the machine axis.

According to a further aspect of the invention, the filling machine has, preferably at the revolving transport element or rotor, a partition or protective wall that extends within the path of movement of the filling elements and that screens the closure elements, which are in the parking position, from the filling elements or filling positions. In order to move the closure elements between their parking positions and working positions, the protective wall can be opened at least partially, namely to release a space for movement for the closure elements.

In a preferred embodiment of the invention, during the movement of the closure elements between the parking position and the working position, there is an additional lifting movement of the closure elements parallel to the machine axis, wherein, in this embodiment too, the final sealing position is preferably achieved between the closure elements moved to the working position and the filling elements only by lowering the filling elements or a part of the transport element or of the rotor that carries them.

"Closure elements," within the meaning of the invention, are, in particular, rinsing caps or rinsing sleeves, but can also include, for example plate-shaped closure elements with which at least a liquid-tight closure of the filling elements is possible in the area of their filling material delivery openings, in particular also by forming a flow path, which encloses the respective filling material delivery opening and is outwardly closed, for a liquid medium, for example for a cleaning and/or disinfection medium used for CIP cleaning and/or CIP disinfection.

"Containers," within the meaning of the invention, include cans, bottles, tubes, pouches, each made from metal, glass and/or plastic material, as well as other packaging means that are suitable for filling with liquid or viscous products.

The term "essentially" or "about" denotes, within the meaning of the invention, variations from the respective exact value by +/−10%, preferably by +/−5% and/or variations in the form of minor changes to the function.

Further developments, advantages, and possible applications of the invention can also be taken from the following description of execution examples and from the figures. To this end, all features described and/or pictorially represented, for themselves or in any combination, in principle, are the subject matter of the invention. The content of the claims is also made a part of the description.

BRIEF DESCRIPTION OF THE FIGURES

Details of the invention, including further advantages thereof, will be apparent from the following detailed description and the accompanying figures, in which.

DETAILED DESCRIPTION

Figure 1:
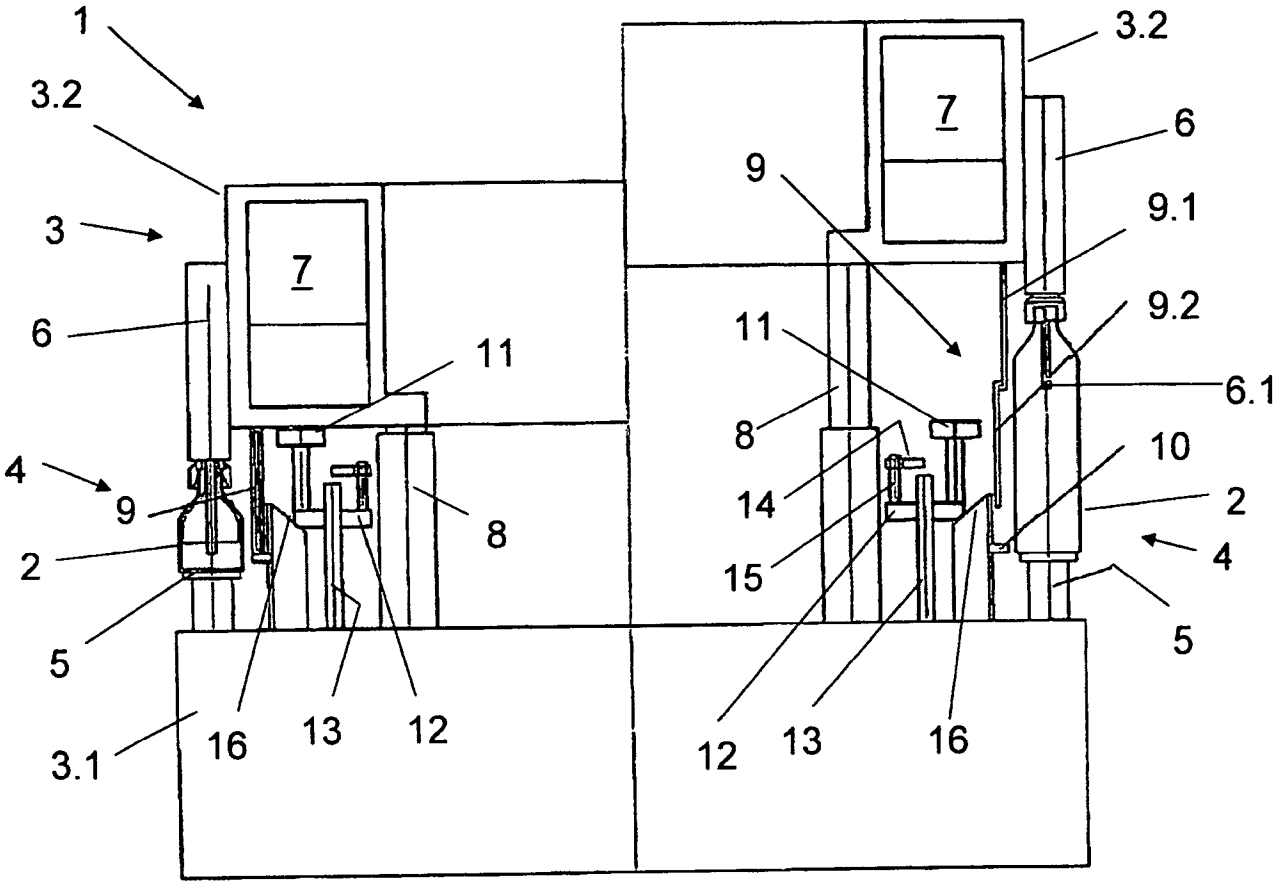
FIGS. 1-3 show, each in schematic representation, a filling machine for filling containers in the form of bottles in different operating conditions.

A revolving filling machine 1 fills containers 2, such as bottles, with a liquid filling material. For this, the filling machine 1 has, at the circumference of a rotor 3 that is driven so as to revolve about a vertical machine axis MA, a large number of filling positions 4 that are supplied with the containers 2 to be filled at a container infeed, and from which filled containers 2 are removed at a container outfeed. The filling of the containers is performed in the angular range of the revolving movement of the rotor 3 between the container infeed and the container outfeed.

In the embodiment shown, each filling position 4 has a container support 5 provided at a lower rotor part 3.1 that is driven so as to revolve about the machine axis MA and a filling element 6, provided at an upper rotor part 3.2 that is driven such as to revolve about the machine axis MA, for controlled feeding, for example for filling-level-controlled and/or filling-quantity-controlled and/or volume-controlled feeding, of the filling material into the respective containers 2 provided at the filling position 4. The filling elements 6 are provided at the circumference of a ring bowl 7 that essentially forms the upper rotor part 3.2 and, that, during the filling operation, is partly filled with the liquid filling material in order to form an upper gas space and a lower liquid space. The latter is connected to the filling elements 6. In the embodiment shown, the container supports 5 are designed as container plates or bottle plates on which the containers, which are oriented with their container axes parallel to the machine axis MA, stand upright on their bottoms.

To enable the filling machine 1 to process containers 2 of different sizes or height, the upper rotor part 3.2 is adjustable in the direction of the machine axis MA relative to the lower container part 3.1 through the use of several telescopic support columns 8.

The filling machine 1 further comprises an annular partition or protective wall 9, which concentrically encloses the machine axis MA. The partition or protective wall is held on the underside of the upper rotor part 3.2 or of the ring bowl 7 and protrudes downward beyond this underside, i.e. in the direction of the rotor part 3.1. The protective wall 9, which is radially offset towards the inside, in respect of the filling positions 4, and which thus prevents contamination (e.g. by filling material and/or shards of burst containers 2) of the inner area of the filling machine 1 or of the rotor 3 and of the local components enclosed by the protective wall 9, is designed such that its axial length relative to the machine axis MA can also be changed so as to adapt to the different settings of the filling machine.

FIG. 1 shows, in the left-hand side, the setting of the filling machine for the processing of containers 2 with the smallest height, in which the rotor part 3.2 is in its bottommost position, and, in the right-hand side, the setting of the filling machine 1 for the processing of the containers 2 with the maximum height, in which the rotor part 3.2 is in its topmost position.

In the embodiment shown, the protective wall 9 is of a two-part design that has two circular ring-shaped wall elements 9.1 and 9.2, each made from a metallic flat material, for example sheet steel, concentrically enclosing the machine axis MA. Of these, the wall element 9.1 is held on the underside of the rotor part 3.2. The wall element 9.2 is displaceable, in the direction of the machine axis MA, relative to the wall element 9.1. Furthermore, means are provided, which are not shown in more detail, for acting between the wall elements 9.1 and 9.2 to lock together and/or hold these wall elements both in a first state of the protective wall 9, in which, according to the left-hand side of FIG. 1, the wall 9 has its minimum height and the two wall elements 9.1 and 9.2 directly adjoin, and in a second state, shown on the right side of FIG. 1, in which the protective wall 9 has its maximum axial height and, for this, the wall elements 9.1 and 9.2 are joined in the direction of the machine axis MA.

The return of the protective wall 2 from its second state to its first state is achieved by lowering the rotor part 3.2. To do this, at least one stop 10 is provided on the lower rotor part 3.1, for example in the form of a ring that concentrically encloses the machine axis MA. When lowering the upper rotor part 3.2, the lower edge of the wall element 9.2 comes to rest against this stop 10, whereby it is pushed into the wall element 9.1. Once the rotor part 3.2 has been fully lowered, the protective wall 9 is in its first state.

In the embodiment shown, the filling elements 6 are each equipped with a probe-like function element 6.1 that protrudes beyond the filling element's underside and, with its axis, is oriented coaxially with a filling element axis FA or parallel to the machine axis MA. This function element 6.1 which, for example, is a probe that determines the filling level and/or a gas pipe or gas return pipe and/or a trinox pipe, i.e. a pipe that serves to introduce a filling material for controlled foaming in the head space of the filled containers 2 for displacing oxygen from this head space, reaches into the respective container 2 during the filling process.

For CIP cleaning and/or sterilization, a closure element in the form of a rinsing cap or rinsing sleeve 11 is allocated to each filling element 6. During the filling operation, these rinsing sleeves 11 are in a parking position within the space enclosed by the protective wall 9. For CIP cleaning and/or disinfection, the rinsing sleeves 11 are moved to their working positions such that each rinsing sleeve 11 tightly closes its associated filling element 6 on its underside and, in particular, also in the area of the local filling material delivery opening and also receives the function element 6.1, as shown in FIG. 3.

Figure 2:
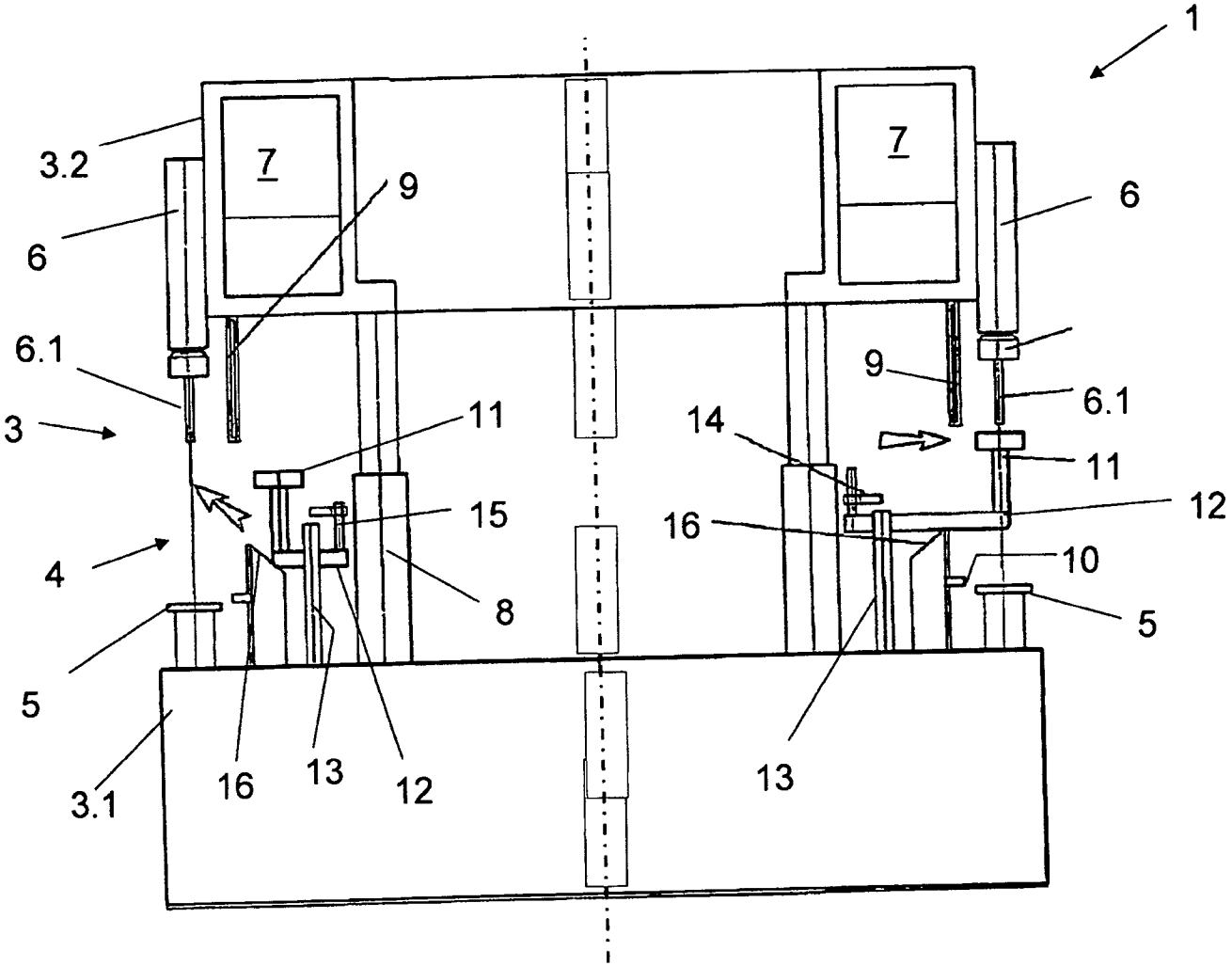
Figure 3:
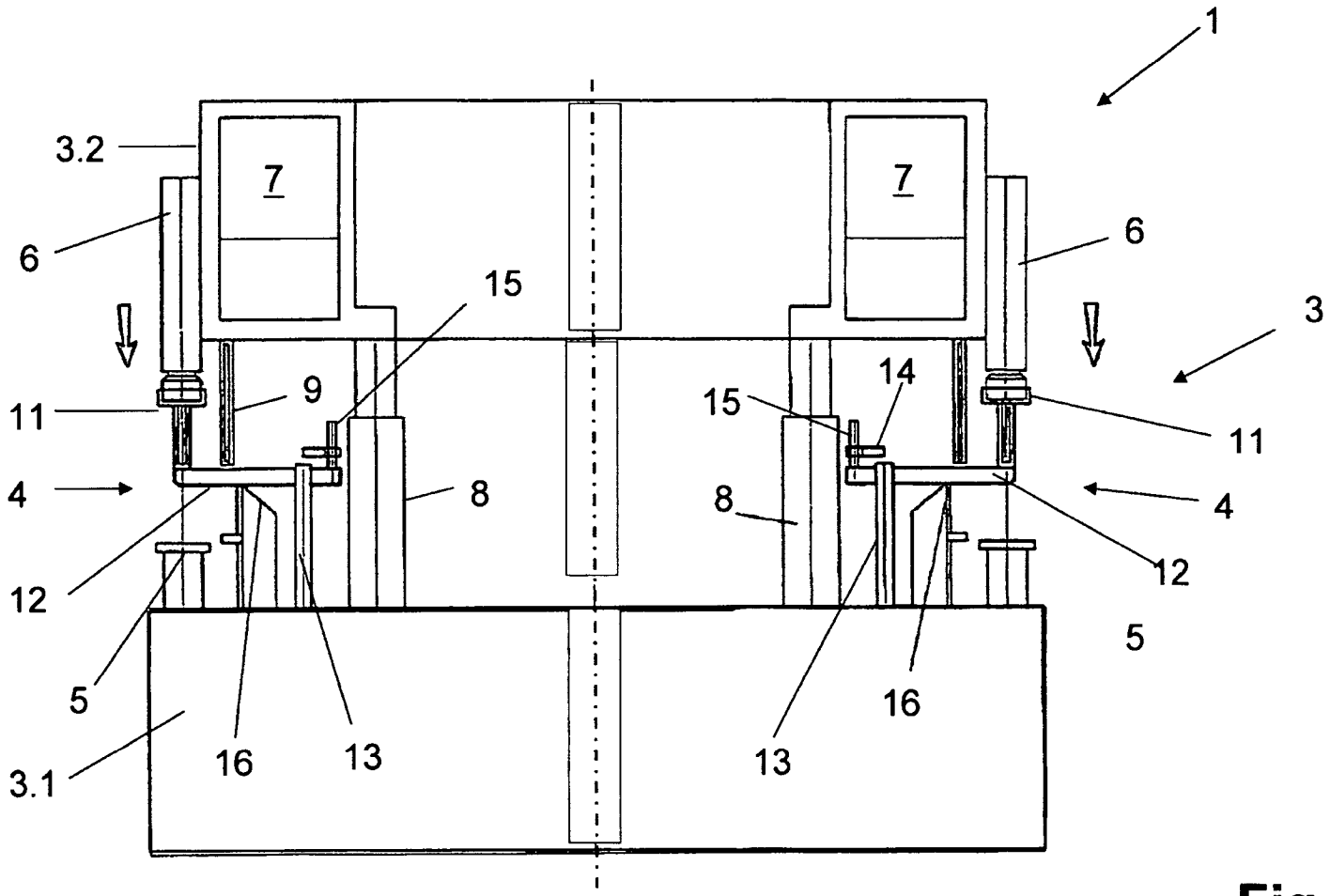

The transfer of the rinsing sleeves from their parking positions, shown in FIG. 1 and in FIG. 2 on the left, to the working positions shown in FIG. 2 on the right or in FIG. 3, in the embodiment shown, is effected by pivoting about a respective axis parallel to the machine axis MA and by simultaneously lifting the rinsing sleeves 11 in the axial direction parallel to the machine axis MA.

However, it is clear that the lifting of the rinsing sleeves 11 does not necessarily have to occur simultaneously with the pivoting of the rinsing sleeves 11.

For this, the rinsing sleeves 11 are each attached to an end of a pivot support in the form of a cranked pivot arm 12 which, by means of a pivot bolt 13, is pivotably supported on the lower rotor part 3.1 about the axis parallel to the machine axis MA and, at the same time, is also guided for displacement in the direction of the machine axis MA on the bolt 13.

Figure 4:
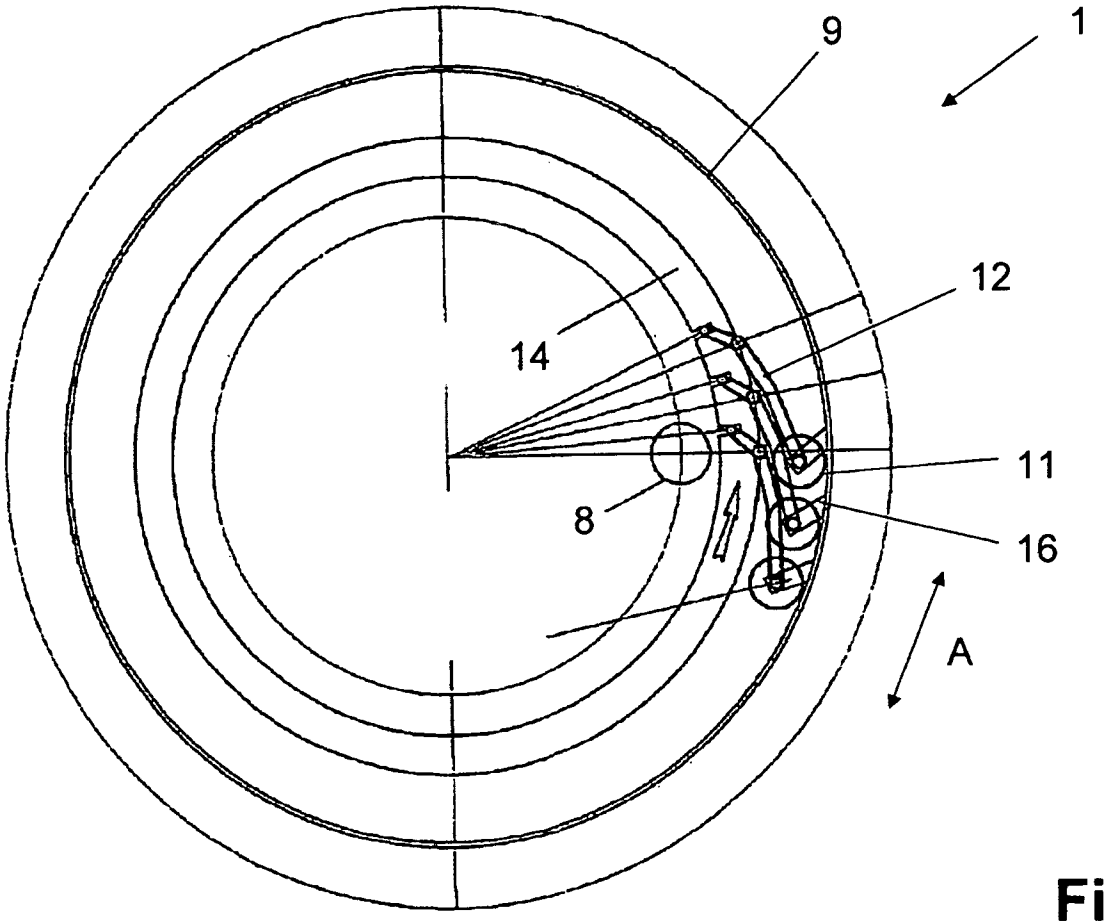
FIGS. 4 and 5 show, each in schematic plan view, some of the closure elements of the filling machine of FIGS. 1-3, together with their pivot supports or pivot arms and a control ring in the parking position or in the working position of the closure elements.
Figure 5:
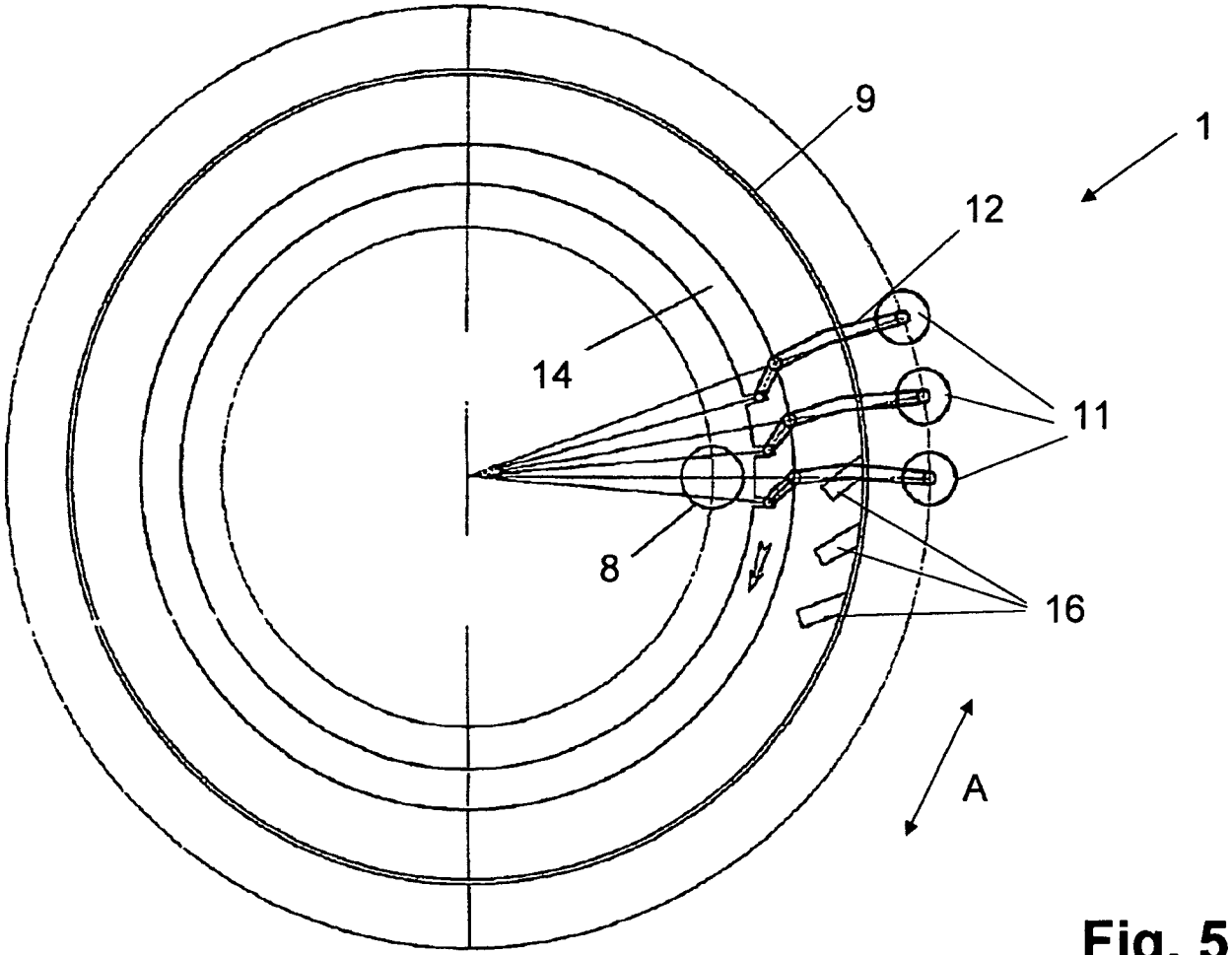

For the common pivoting of all rinsing sleeves 11 or their pivot arms 12, there is a control or pivot ring 14 that is arranged concentrically with the machine axis MA and that is rotatable for the pivoting of the rinsing sleeves 11 or of the pivot arms 12 by a specified angular amount about the machine axis MA, as indicated by the double arrow A in FIGS. 4 and 5. In some embodiments, the pivot ring 14 is equipped with a large number of control slits into each of which a bolt-shaped driver 15 of each pivot arm 12 engages such that the revolving movement A of the pivot ring 14 causes the necessary pivoting movement of all pivot arms 12.

In the embodiment shown in FIGS. 1-5, the bolt-shaped driver 15 with its axis also oriented parallel to the machine axis MA is provided at the end of the respective pivot arm 12 that lies distant from the rinsing sleeve 11. The support of the pivot arm 12 on the bolt 13 is located between the two ends of the pivot arm 12 at a distance, from the rinsing sleeve 11, which is much greater than the distance from the driver 15.

At each filling position 4, a lifting cam 16 is provided that, in the embodiment shown, is formed by an inclined surface that, with a notional plane oriented perpendicular to the machine axis MA, encloses an acute angle, i.e. an angle smaller than 90°, and on which the respective pivot arm 12 glides from the parking position to the working position during pivoting, whereby the respective rinsing sleeve 11, by this pivoting action, is also simultaneously lifted in the direction of the machine axis MA. In the working position, the respective rinsing sleeve 11 is arranged coaxially with the axis FA of the associated filling element 6.

The changeover of the filling machine 1 from the operating condition "filling" to the operating condition "CIP cleaning and/or sterilization" occurs such that, when no more containers 2 are at the filling positions 4, the upper rotor part 3.2 is lowered to the bottommost position, whereby, by pushing together the wall elements 9.1 and 9.2, the protective wall 1 is transferred to its first state. In case of directly adjoining and locked-together wall elements 9.1, the upper rotor part 3.2 is moved back to an upper position so that the state shown in FIG. 2 on the left is then achieved. Thereafter, all rinsing sleeves 11 are pivoted to their working positions by pivoting the pivot ring 14 and are thus lifted, as shown on the right side of FIG. 2.

It is understood that the pivoting and lifting movement of the rinsing sleeves 11 and of the pivot arms 12 and the axial length of the protective wall 9 in its first state are adapted to each other such that the rinsing sleeves 11 and the pivot arms 12 during this pivoting and lifting movement do not hit against the lower edge of the protective wall 9, but always have a sufficient distance from the protective wall 9. The protective wall 9 is distanced from the pivot arms 12 even if the rinsing sleeves 11 are in their working positions.

Following positioning of the rinsing sleeves 11 in their working positions, in which the rinsing sleeves 11, initially, are still axially distanced from the filling elements 6 and, in particular, also from their probe elements 6.1 and in which the respective pivot arm is supported on the lifting cam 16, the upper rotor part 3.2 is lowered so that, finally, all filling elements 6 with their undersides each form a seal as they rest against a rinsing sleeve 11. In addition, the probe-like function elements 6.1 of the respective rinsing sleeve 11 are accommodated. After performing the CIP cleaning and/or CIP disinfection, the rinsing sleeves 11 are returned to their parking positions, initially by lifting the upper rotor part 3.2 and by subsequent pivoting and lowering.

In the parking position, the rinsing sleeves 11 are accommodated within a space enclosed by the protective wall 9 or its notional extension. In the working position, the rinsing sleeves 11 in relation to the machine axis MA are outside this space.

Figure 6:
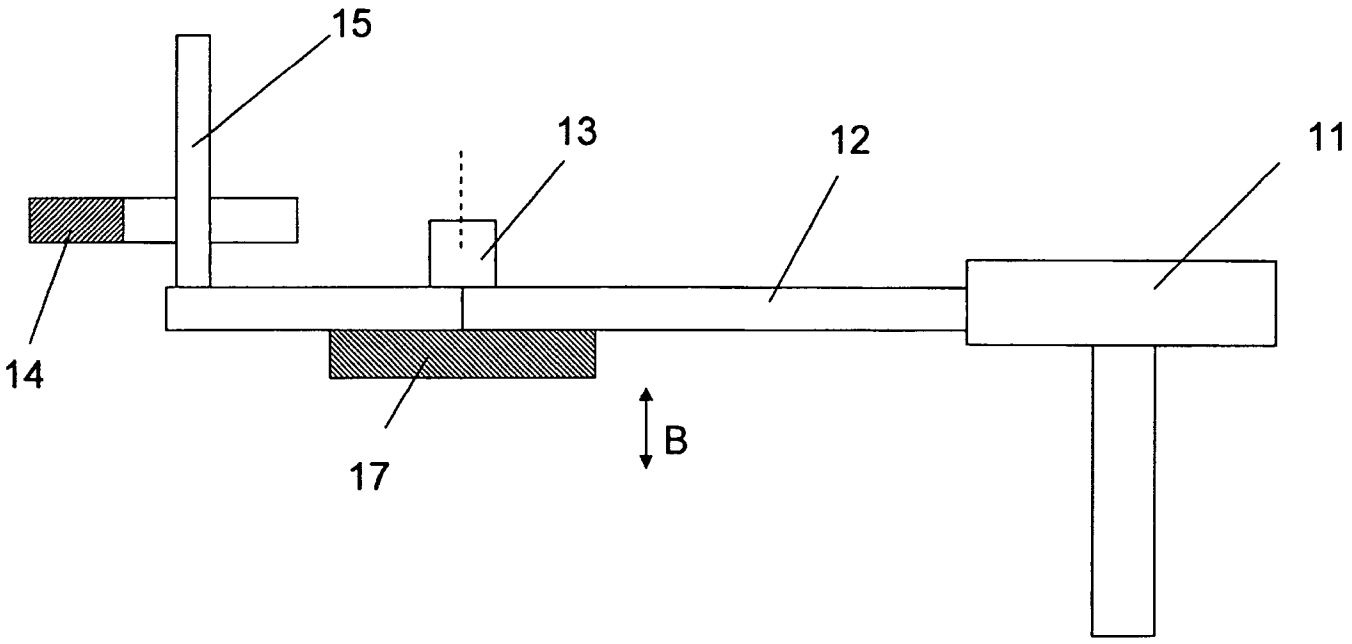
FIG. 6 shows, in a simplified schematic side view, one of the closure elements, together with its pivot support or pivot arm.

Above, it was assumed that the lifting or lowering of the rinsing sleeves 11 during moving or pivoting between the parking position and the working position is effected by lifting cams 16. Other embodiments are also possible. For example, according to FIG. 6, the pivot arms 12 are supported on a bearing element 17 that itself can be lifted and lowered in the direction of the machine axis MA, as indicated by the double arrow B in this figure. Preferably, the bearing element 17 is an annular bearing element, common to all closure elements or rinsing sleeves 11 or to all pivot arms 12, that concentrically encloses the machine axis MA.

Figure 7:
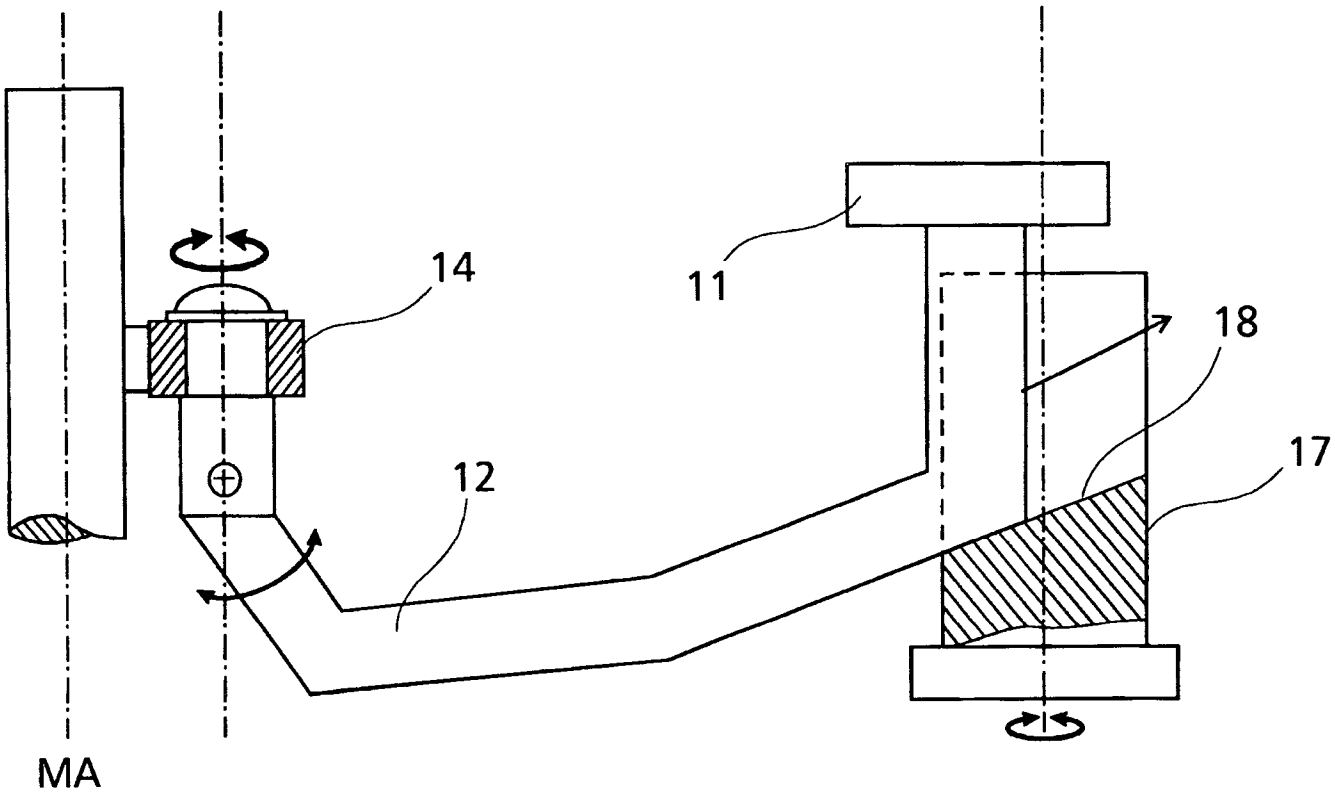
FIGS. 7 and 8 show a further embodiment of the present invention, in which the lifting movement of a pivot arm is effected by means of an inclined plane arranged in a bearing element.
Figure 8:
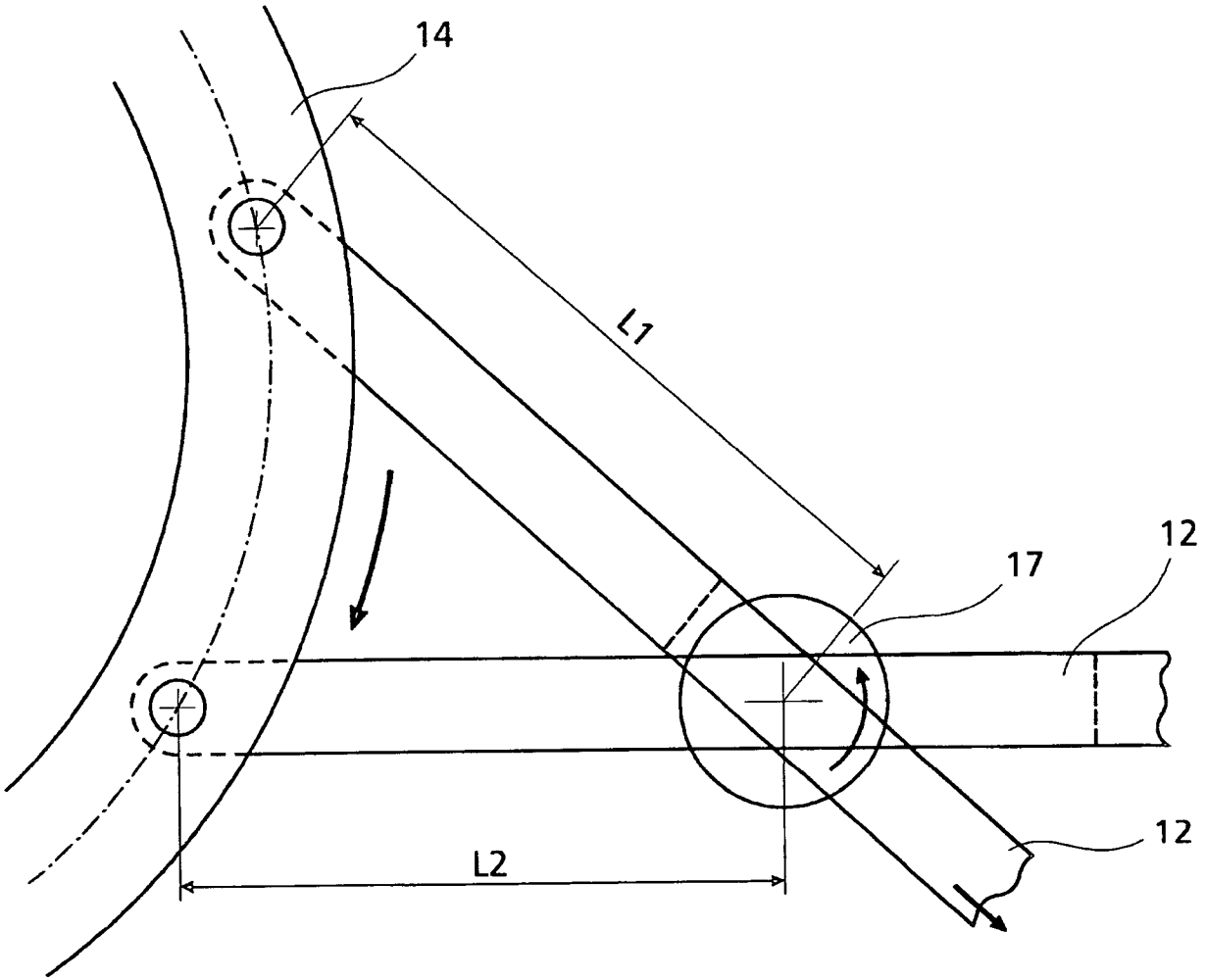

In the example shown in FIGS. 7 and 8, the lifting movement of the pivot arm is effected by an inclined plane 18 arranged within the bearing element 17. To be geometrically adapted to this inclined plane 18, the front end of the pivot arm 12 is at an angle that matches the inclined plane 18 and preferably is also supported on the inclined plane 18.

If the rinsing sleeve 11 is now moved from its initial position to its working position, then the pivot ring 14 moves from its initial position towards the bearing element 17. The pivot arm 12 is then moved through the bearing element 12. The movement of the pivot arm 12 arises by shortening the length of the pivot arm 12, located between pivot ring 14 and bearing element 17, from the initial length L1 to the final length L2.

As can be seen from FIG. 7, the pivot arm 12 in its initial position is at least partly supported on the inclined plane 18 so that the pivot arm 12 is lifted by its movement relative to the pivot arm 12 and thus also relative to the inclined plane 18.

Due to the geometric dimensions of the entire device and the movements of the pivot ring 14, the pivot arm 12 is thus lifted in its entirety, displaced, in terms of length, relative to the bearing element 17, and, additionally, revolved with its vertical axis about the revolving axis of the bearing element 17. In this respect, the order in which the individual movements occur and the extent of the individual part movements are insignificant within the meaning of the present invention.

With the design according to the invention, in particular by combining the pivoting movement and the lifting movement, the path of movement of the rinsing sleeves 11 during movement between the parking position and the working position is designed such that the rinsing sleeves 11 still find space, even when processing the containers with the smallest height, under the upper rotor part 3.2, and designed such that the lower edge of the protective wall 9 during CIP cleaning and/or CIP disinfection is not supported on the pivot arms 12, and designed such that the projecting probe-like elements 6.1 of the filling elements 6 can be fully accommodated in the respective rinsing sleeve and a liquid-tight connection between the rinsing sleeve 11 and the filling element 6 can thus be made.

The invention has been described above using selected examples. It is understood that numerous changes and modifications are possible. In particular, it is also possible to interchange the position of the pivoting axis and of the driver 15 at the pivot arms 12 such that the driver 15 is provided between the two ends of the respective pivot arm 12.

LIST OF REFERENCE SYMBOLS

1 filling machine
2 container
3 rotor
3.1, 3.2 rotor part
4 filling position
5 container support
6 filling element
6.1 probe-like function element
7 ring bowl
8 support column
9 protective wall
9.1, 9.2 wall element
10 stop
11 rinsing sleeve
12 pivot support or pivot arm
13 pivot and guide bolt
14 pivot ring
15 driver
16 lifting cam
17 bearing element
18 inclined plane
A pivoting movement of the pivot ring 14
B lifting movement of the bearing element 17
FA filling element axis
MA machine axis

The invention claimed is:

1. An apparatus comprising a filling machine for filling containers with a liquid filling material, said filling machine comprising a rotor, a transport element, a vertical machine axis, and a multiplicity of filling positions, each of which comprises a filling element, a container support, and a closure element, and a common actuating drive for all closure elements of said filling machine, wherein said transport element is driven to revolve on said rotor about said vertical machine axis, wherein said filling positions are on said transport element, wherein said closure element is selected from the group consisting of a rinsing cap and a rinsing sleeve, wherein said common actuating drive is configured to simultaneously move each closure element between a parking position and a working position along said vertical machine axis, wherein, in said parking position, said closure element is within a path of movement of said filling elements, and wherein, in said working position, said closure element is arranged coaxially with said associated filling element and below said filling element.

2. The apparatus of claim 1, further comprising a protective wall, wherein said protective wall extends along a path of movement of said filling elements, wherein said protective wall is arranged within said path of movement, wherein said protective wall is arranged on a structure selected from the group consisting of said transport element and said rotor, wherein said protective wall has an axial height that extends in a direction of said machine axis, wherein said axial height can be reduced for release of a space for movement, and wherein, within said space for movement, said closure elements are moved between said parking position and said working position.

3. The apparatus of claim 1, wherein said closure elements are moved by pivoting about at least one axis parallel to said machine axis between said parking position and said working position.

4. The apparatus of claim 3, further comprising a pivoting structures, wherein each of said closure elements is provided on a corresponding one of said pivoting structures, wherein each of said pivoting structures is pivotable about a pivot axis, wherein each of said pivoting structures is selected from the group consisting of a pivot support and pivot arm.

5. The apparatus of claim 1, further comprising means for generating controlled vertical movement of said closure elements along said machine axis during movement thereof between said working position and said parking position.

6. The apparatus of claim 5, wherein said means for generating controlled vertical movement is configured for lifting said closure elements during movement from said parking position to said working position and for lowering said closure elements during movement from said working position to said parking position.

7. The apparatus of claim 5, wherein said means for generating said controlled vertical movement of said closure elements comprises lifting cams that can be moved in a controlled manner along said direction of said machine axis.

8. The apparatus of claim 7, wherein said lifting cams are provided separately for each filling position.

9. The apparatus of claim 7, further comprising pivot bearings, wherein said pivot bearings are coupled to said closure elements, and wherein said lifting cams work together with said pivot bearings.

10. The apparatus of claim 9, further comprising a bearing element, wherein said bearing element is a constituent of said pivot bearings, and wherein said bearing element is common to at least two filling positions.

11. A method for controlling a filling machine as recited in claim 1, wherein said rotor includes a lower rotor part, and an upper rotor part, wherein said upper rotor part is height adjustable, at the lower rotor part, in said direction of the machine axis, and wherein said method comprises raising said upper rotor part, and, while said upper rotor part is raised, moving said closure elements between said parking positions and said working positions.

12. The method of claim 11, further comprising causing liquid-tight closure of a filling element with an associated closure element, wherein causing liquid-tight closure comprises lowering said filling element onto said closure element, wherein lowering said filling element comprises, while lowering said upper rotor part.

13. An apparatus comprising a filling machine for filling containers with a liquid filling material, said filing machine comprising a transport element, a rotor, a vertical machine axis, and a multiplicity of filling positions, each of which comprises a filling element, a container support, and a closure element, and a protective wall, wherein said protective wall extends along a path of movement of said filling elements, wherein said protective wall is arranged on a structure within said path of movement, wherein said structure is selected from the group consisting of said transport element and said rotor, wherein said transport element is driven such as to revolve on said rotor wherein said rotor is driven such as to revolve about said vertical machine axis, wherein said closure element is selected from the group consisting of a rinsing cap and a rinsing sleeve, wherein each closure element can be moved by a drive between a parking position and a working position, wherein, in said parking position, said closure element is within a path of movement of said filling elements, wherein, in said working position, said closure element is arranged coaxially with said associated filling element and below said filling element, wherein said protective wall has an axial height along a direction of said machine axis, wherein said axial height can be reduced to create a space for movement, and wherein said closure elements are moved in said space for movement between said parking position and said working position.

14. The apparatus of claim 13, further comprising a common actuating drive that is provided for all closure elements of said filling machine.

15. The apparatus of claim 13, wherein said closure elements are moved by pivoting about at least one axis parallel to said machine axis between said parking position and said working position.

16. The apparatus of claim 15, further comprising a pivoting structures, wherein each of said closure elements is provided on a corresponding one of said pivoting structures, wherein each of said pivoting structures is pivotable about a pivot axis, wherein each of said pivoting structures is selected from the group consisting of a pivot support and pivot arm.

17. A method of operating a filling machine as recited in claim 13, wherein said method comprises reducing said axial height of said protective wall prior to moving said closure element.

* * * * *